US005806284A

United States Patent [19]

Gifford

[11] Patent Number: 5,806,284

[45] Date of Patent: Sep. 15, 1998

[54] METHOD AND SYSTEM FOR PRODUCING SEALED PACKAGES OF A FILM WHICH IS DISSOLVED IN A BODY FLUID

[75] Inventor: Glen F. Gifford, Verona, N.J.

[73] Assignee: Apothecus Pharmaceutical Corp., Oyster Bay, N.Y.

[21] Appl. No.: 810,570

[22] Filed: Mar. 3, 1997

[51] Int. Cl.[6] ..... B65B 63/00

[52] U.S. Cl. ..... 53/435; 53/202; 53/450; 53/520; 53/553

[58] Field of Search ..... 53/202, 435, 450, 53/513, 514, 520, 546, 553, 554, 555; 83/107, 156, 408; 242/525.6, 525.7; 271/900

[56] References Cited

U.S. PATENT DOCUMENTS

| | | | |
|---|---|---|---|
| 1,348,553 | 8/1920 | Dowell | 83/107 |
| 2,673,430 | 3/1954 | Fleischer | 53/546 |
| 3,020,687 | 2/1962 | Joa | 53/53 |
| 3,103,843 | 9/1963 | Schoenberger | 83/107 |
| 3,140,572 | 7/1964 | Peterson | 53/435 |
| 3,168,056 | 2/1965 | Enagels | 83/107 |
| 3,611,856 | 10/1971 | Adair | 83/408 |
| 3,824,011 | 7/1974 | Suzuki et al. | 271/900 X |
| 3,955,889 | 5/1976 | Ishiguro et al. | 271/900 X |
| 3,978,642 | 9/1976 | Smithers | 271/900 X |
| 4,111,087 | 9/1978 | Pan Kvatz | 53/518 |
| 4,538,801 | 9/1985 | Van Pelt | 271/251 |
| 4,566,162 | 1/1986 | Brands | 271/900 X |
| 4,729,557 | 3/1988 | Kiyohara | 271/900 X |
| 4,932,932 | 6/1990 | Schmidt | 83/408 |
| 5,069,057 | 12/1991 | Wilkinson | 53/439 |
| 5,117,610 | 6/1992 | Hartman | 53/435 |
| 5,197,262 | 3/1993 | Katz | 53/553 |
| 5,205,106 | 4/1993 | Zimmermann et al. | 53/118 |
| 5,393,528 | 2/1995 | Staab | 424/436 |

*Primary Examiner*—Daniel Moon
*Attorney, Agent, or Firm*—Galgano & Burke

[57] ABSTRACT

A system for packaging a water soluble medicant film which is dissolvable in a body fluid within a multi-ply packaging material which comprises a spool of dissolvable film, a mechanism for longitudinally cutting the film into at least two webs, a mechanism for drawing each of the webs through a roller assembly, a mechanism for laterally separating the webs, a mechanism for preventing the webs from adhering to the drawing mechanism, a mechanism for transversely cutting the webs into individual dosages of film, and a mechanism for sealing the film dosages between the packaging plies.

16 Claims, 4 Drawing Sheets

METHOD AND SYSTEM FOR PRODUCING SEALED PACKAGES OF A FILM WHICH IS DISSOLVED IN A BODY FLUID

The present invention relates to a system and a method for providing a product in a sealed package. More particularly, the present invention relates to a system and method for providing a dissolvable film in a plurality of individually sealed dosages.

BACKGROUND

Dissolvable films are a very convenient and highly effective delivery system for providing active ingredients to a site within a patient's body. For example, a dissolvable contraceptive film comprising nonoxynol-9 as an active ingredient in a dissolvable film comprising glycerin and polyvinyl alcohol, provide a low cost and effective method of contraception and advantageously minimize the risk of disease transmittal when inserted vaginally shortly before intercourse. Since the required film dosages are small, the film has the advantage of being very discreet since the film dissolves within minutes, yet it maintains its spermicidal action for about one hour. Such film is also environmentally friendly as it is eventually washed away with natural body fluids.

Due to the physical properties of contraceptive films and other films of this type which dissolve in a body fluid, the manufacturing and packaging of such products provides unique problems. For marketing purposes, the goal is to produce sealed packages, each containing a single dose of the dissolvable film.

It is desirable to manufacture the film in bulk-scale to reduce the overall cost of manufacturing the product as well as to increase to overall yield of the product. However, once the product is manufactured on a bulk-scale level, the product must then be packaged in lesser quantities for distribution and sale to customers. For example, the dissolvable contraceptive film, is typically manufactured in bulk to reduce manufacturing costs and is then packaged in individual dosages for the consumer. This process can lead to considerable waste and low production yields.

One common packaging process has been to load several spools of a product onto the packaging machine and run the webs through a series of rollers which manipulate and align the product for packaging purposes. The packaging material is then introduced into the line to wrap and seal the product. For example, one known method is to feed different spools of the product simultaneously through a cutting blade where a geared mechanism determines the cutting time between each revolution to assure proper dosaging of the product. The individual dosages of the product are then packaged and sealed in pouches which can be formed in strips with distinct perforations between each pouch.

This process has many disadvantages. For example, because each spool of the product will inevitably be slightly different in the outer dimensions from the core, and therefore longer or shorter in overall length, a large amount of waste can occur when one roll runs out of material before another roll. By the time the machine operator of the line realizes that this has occurred, strips of the product will come off the line with empty pouches thus wasting the product as well as the packaging material. Overall production speed can also suffer because rolls are continuously being replaced causing the line to be completely shut down. This problem is exacerbated because as the first roll runs out and is replaced by a new one, short rolls remain which will inevitably require additional frequent roll changes at different time intervals. Upon each startup, product and pouch material are, again, wasted until the line is up and at full speed. As a result, loss factors can be far above desired levels.

Furthermore, film products which are readily dissolvable within body fluids tend to adhere to certain types of rollers as the film passes through the machine.

It would therefore be desirable to provide a system and method for producing sealed packages of a water soluble film which is dissolvable in a body fluid and a system which can solve many of the disadvantages noted above and which efficiently packages a product at a low cost with minimal amounts of waste.

SUMMARY OF THE INVENTION

To overcome some of the noted disadvantages with prior processes, it has been determined that instead of using and coordinating several rolls of a product on line for packaging, one uses embodiment of the present invention and coordinates one larger spool. The larger spool has to be slit and separated on-line into a plurality of webs prior to cutting the webs laterally into individual dosages. This method enables a manufacturer to package a product with minimal down time and minimal waste. Moreover, when a single, larger roll is completed, the entire roll can be changed as opposed to changing several, smaller rolls at different times. As a result, yields will increase due to fewer startups and fewer empty pouches.

Various embodiments of the present invention provide a system for packaging a water soluble medicant film within a multi-ply packaging material which comprises a spool of the water soluble medicant film and a multi-ply packaging material, a mechanism for longitudinally cutting the film into at least two webs, a mechanism for drawing each of the webs through the packaging machine, a mechanism for laterally separating the webs, a mechanism for preventing the webs from adhering to the drawing mechanism comprising a guide plate with at least one notch located therein, a mechanism for transversely cutting the webs into individual dosages of film, and a mechanism for sealing the film dosages between the packaging plies.

One embodiment of the present invention comprises a turn bar comprising at least two rollers for drawing the webs through the packaging machine. Preferably the surface of the rollers which control the film is formed of a synthetic resin polymer product such as that sold under the trademark TEFLON®, and/or another material with a low coefficient of friction, e.g., silicon. TEFLON® or silicon-coated rollers are utilized to insure continuous motion of the film without adhesion to system parts as it approaches the cutting mechanism.

Advantageously, a guide plate is positioned after the drawing rollers to also prevent the film from adhering to the outer surface of the drawing rollers. For example in one embodiment, the guide plate comprises at least two notches located therein which are sufficiently dimensioned to accept a portion of the drawing rollers, i.e., the drawing rollers are partially inset within the notches so as to prevent the film from riding along the outer surface of the roller.

In one preferred embodiment, the drawing mechanism also aligns the film as it moves toward the cutting mechanism. Advantageously, a knife or rotary blade acts as the cutting mechanism for cutting the film in either or both the longitudinal and/or the lateral (transverse) direction. Preferably, a roller and/or roller assembly is utilized to vertically re-align the webs after lateral separation.

Other embodiments of the present invention comprise a method of providing individual dosages of a dissolvable film within a multi-ply package which comprises the steps of feeding a spool of dissolvable film into a roller assembly, longitudinally cutting the film into at least two webs, drawing each of the webs through a roller assembly, laterally separating the webs, preventing the webs from adhering to the drawing mechanism utilizing a guide plate with at least one notch located therein, transversely cutting the webs into individual dosages of dissolvable film, and sealing the dosages between the plies.

These and other aspects of the present invention are described in greater detail below.

BRIEF DESCRIPTION OF THE DRAWINGS

In the drawings, wherein similar reference characters denote similar elements throughout the several views.

DETAILED DESCRIPTION

Figure 1:
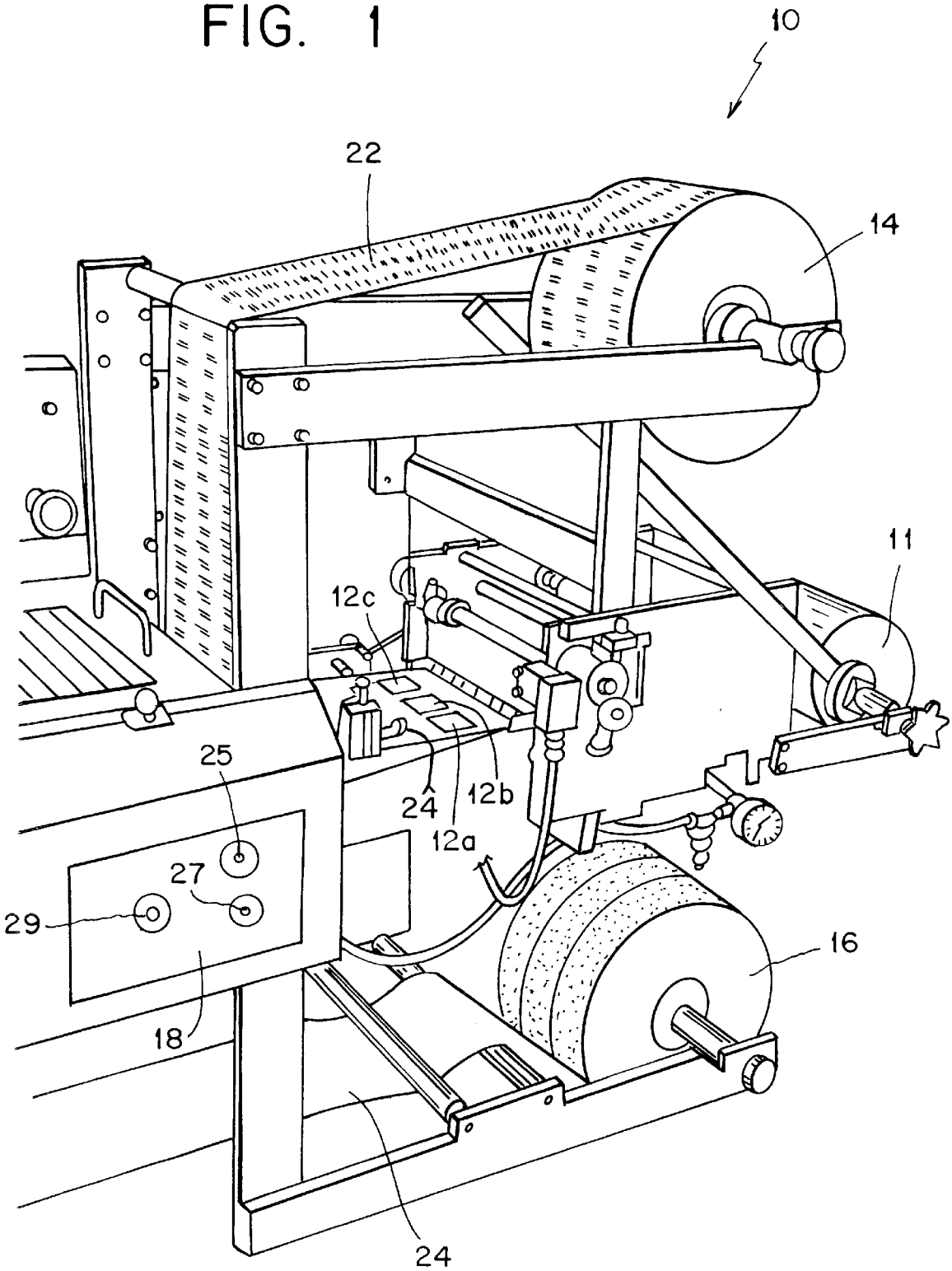
FIG. 1 is a perspective view of one embodiment of the system.

In accordance with one embodiment the present invention, a system for packaging a water soluble and/or dissolvable film within a two-ply package which comprises a spool of medicated film which is water soluble and/or dissolvable in a body fluid, a packaging material comprising a first ply and a second ply, a mechanism for longitudinally cutting the dissolvable film into at least two webs (and preferably three) a mechanism for drawing each of the webs through at least one roller assembly, a mechanism for laterally separating the webs, a mechanism for preventing the webs from adhering to the drawing mechanism comprising a guide plate with at least one notch located therein, a mechanism for transversely cutting the webs into individual dosages, and a mechanism for sealing the dosages between the plies. Advantageously, the engagement surface of the drawing roller comprises silicon or some other material with a low coefficient of friction.

Another embodiment of the present invention comprises a method of providing a water dissolvable and/or a film which is dissolvable within a body fluid and providing the film within a multi-ply package and comprises the steps of:

1. feeding a spool of dissolvable, medicated film into a roller assembly;
2. longitudinally cutting the film into at least two webs;
3. drawing each of the webs through at least one roller assembly;
4. laterally separating the webs;
5. transversely cutting the webs into individual dosages of dissolvable film;
6. preventing the webs from adhering to the drawing mechanism by providing a guide plate comprising at least one notch located therein; and
7. sealing the dosages between the plies.

In one particular embodiment, the drawing mechanism comprises a turn bar and at least one roller or roller assembly which draws the product through the system. In another embodiment, the drawing mechanism also aligns each web of product for cutting by the transverse cutting mechanism and positioning on the packaging ply. Preferably, at least a portion of each of the rollers is at least partially inset within one of the notches. Advantageously, the number of rollers is equivalent to the number of webs and each of the rollers draws a corresponding web through the packaging system. In one particular embodiment, the number of notches is equivalent to the number of rollers and each roller is positioned at least partially within a corresponding notch.

Preferably, each roller is centrally aligned on each web and centrally aligned within each notch, however, in some cases it may be desirable to offset the rollers on the web or within the notch to improve packaging performance.

Preferably, both the transverse cutting mechanism and the longitudinal cutting mechanism comprise at least one knife and/or blade. For example, in a preferred embodiment, the transverse cutting mechanism comprises a rotary blade wherein one side reciprocates substantially vertically and the other side travels in a generally elliptical or circular path.

In one preferred embodiment of the present invention, the system further comprises a vertical re-alignment mechanism for vertically re-aligning the webs after separation. Preferably, the vertical re-alignment mechanism comprises at least one roller for re-aligning the individual webs.

In another preferred embodiment, the method of providing further comprises the step of vertically re-aligning the individual webs after they have been separated from one another. In yet another embodiment, the method of packaging further comprises the step of aligning the dosages onto one of the plies.

One embodiment of the present invention is illustrated in FIG. 1 and comprises a system 10 which comprises a spool 11 of dissolvable contraceptive film 12. Preferably, film 12 is dissolvable in a body fluid, e.g, vaginal fluid, and comprises a medicant such as nonoxynol-9 which is commonly utilized as a contraceptive. However, other contraceptive ingredients or other medicants can also be employed within the dissolvable film 12. The packaging system also comprises a packaging material which is preferably constructed from two plies—a top ply 22 and a bottom ply 24. Advantageously, both plies are rolled in large spools 14 and 16, respectively, for manufacturing and packaging purposes.

The illustrated system also comprises a control panel 18 for adjusting the speed of the packaging process. Advantageously, panel 18 controls the rotational speed of spools 11, 14 and 16 enabling system 10 to be selectively adjusted to various manufacturing speeds and production levels. Preferably, panel 18 also comprises a mechanism 25 for adjusting the speed of each individual spool 11, 14 and 16 to increase manufacturing accuracy and efficiency. Most preferably, panel 18 also comprises a mechanism 27 for selectively adjusting the size of the individual dosages (e.g. 13*a*, 13*b* and 13*c*) of film 12 and/or for adjusting the position of the guide plate 42 with respect to the turn bar 38 and the drawing rollers 40*a*, 40*b* and 40*c*.

Figure 2:
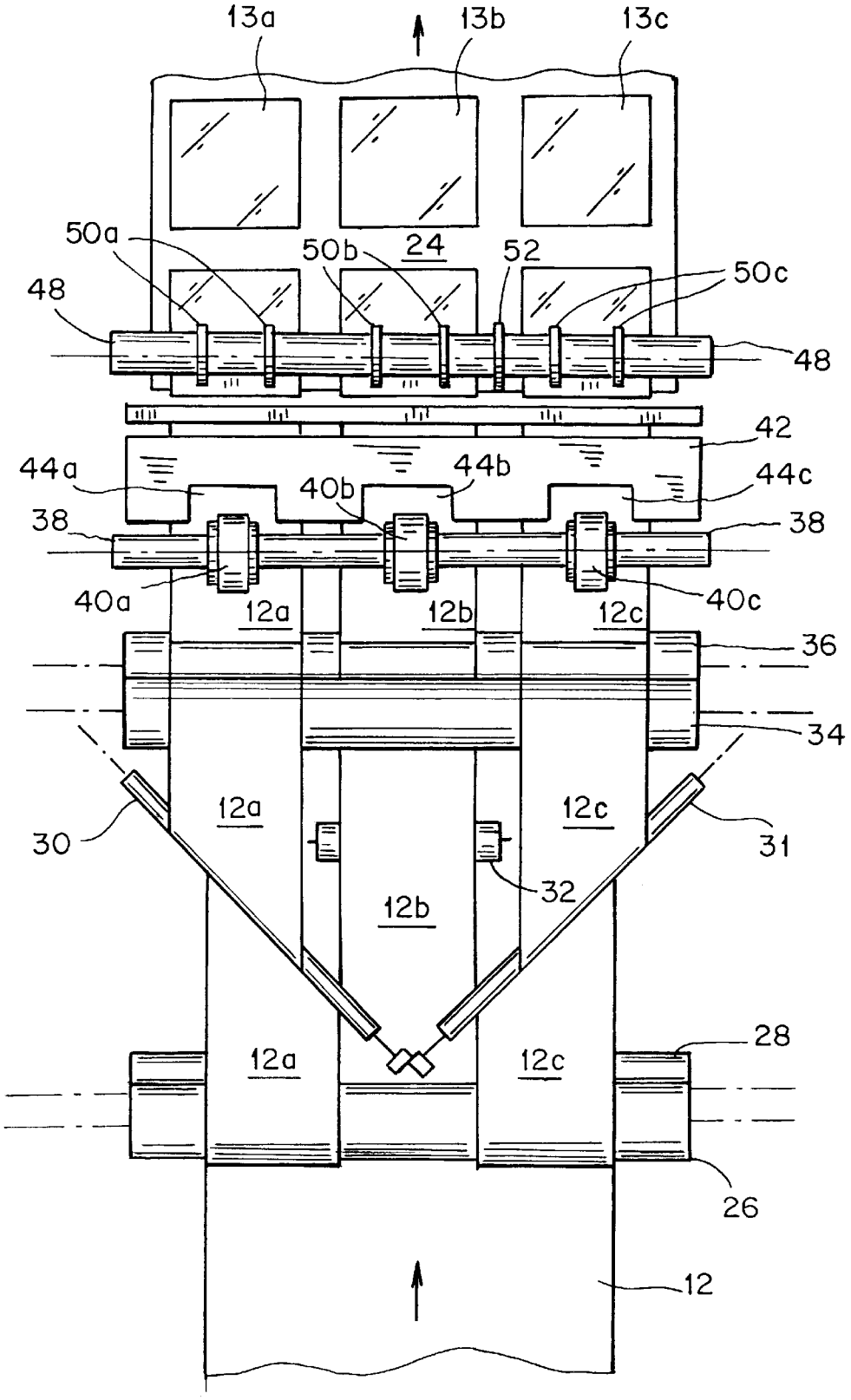
FIG. 2 is a top plan view of the FIG. 1 embodiment showing the film being cut, separated, aligned, cut and positioned atop a packaging ply as the film moves through the system.
Figure 3:
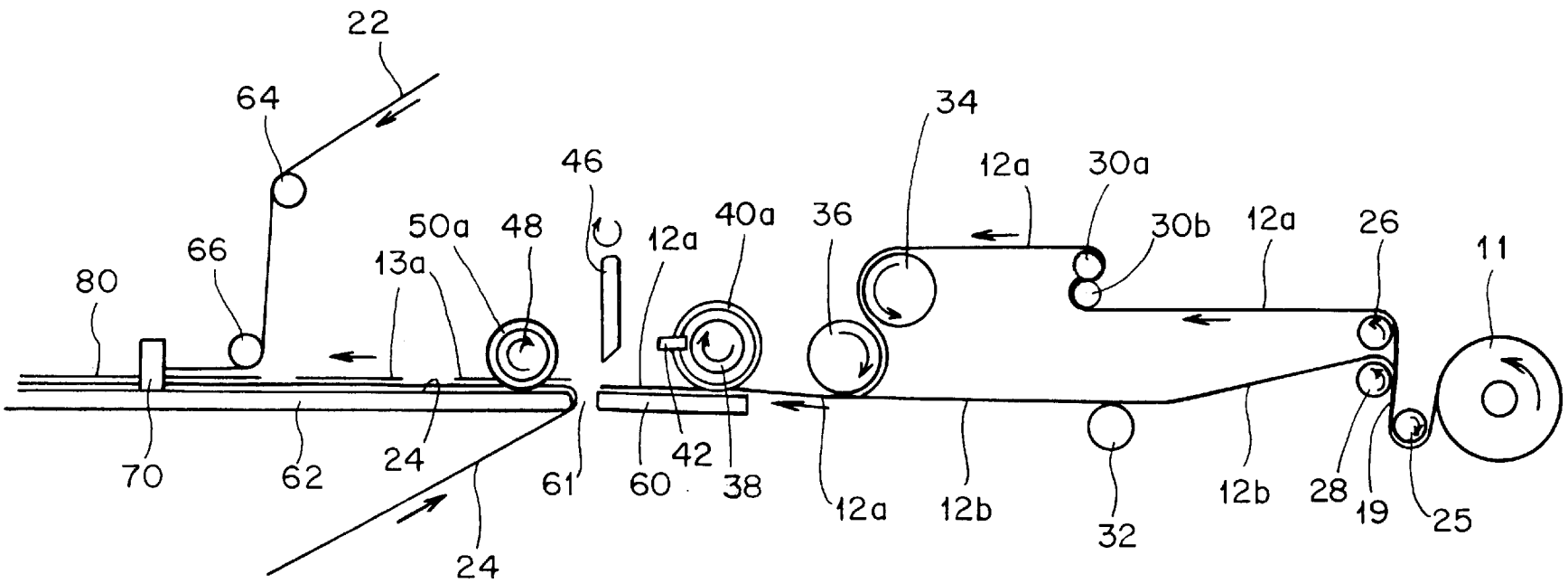
FIG. 3 is a schematic diagram of one embodiment of the present invention.
Figure 4:
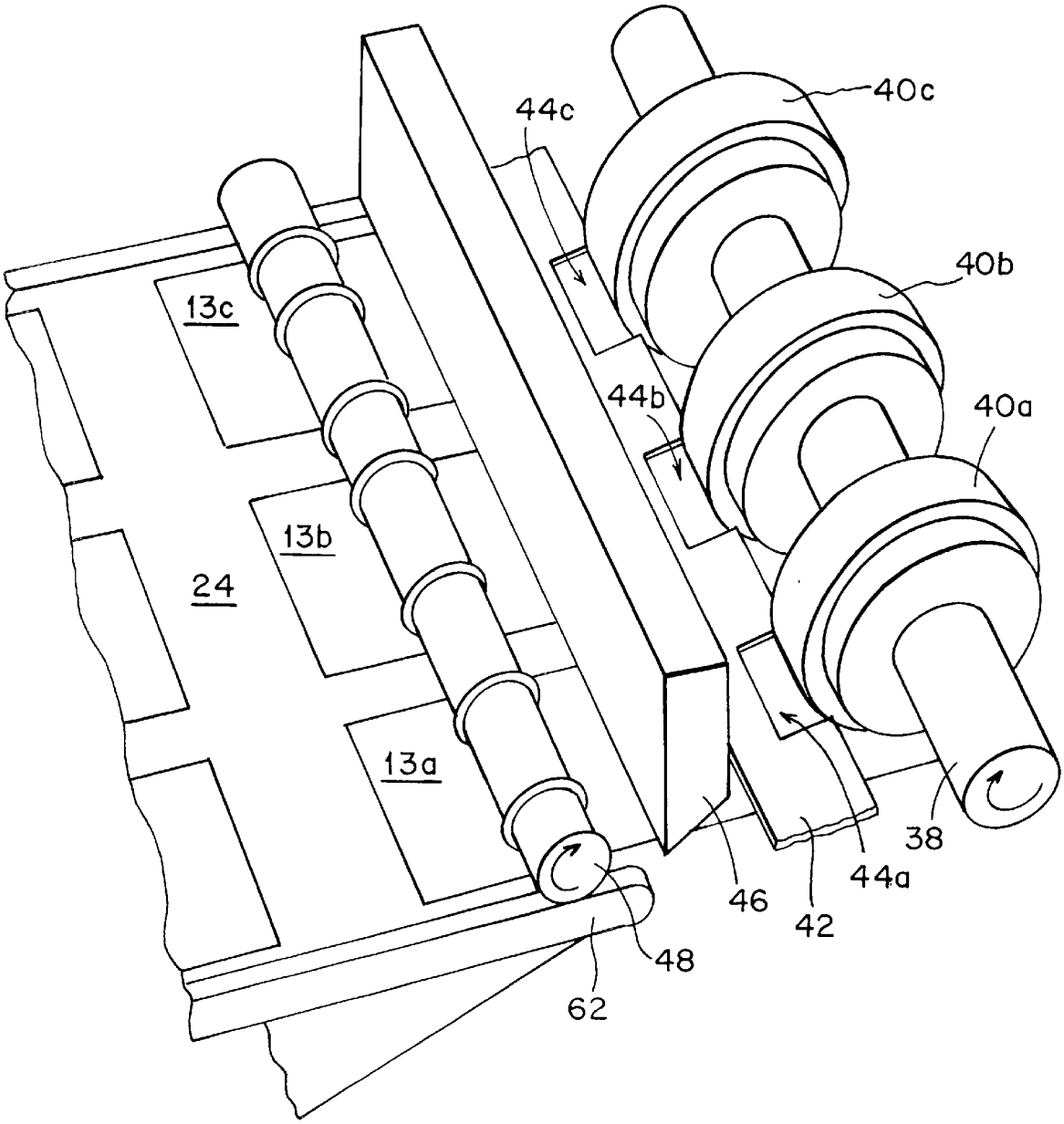
FIG. 4 is an enlarged perspective view of the drawing mechanism and guide plate.

As illustrated in FIG. 1 but more clearly seen in FIG. 2, a series of knives and rollers operate to separate and cut film 12 into individual dosages 13*a*, 13*b* and 13*c* and position each dose on bottom packaging ply 24. More particularly, film 12 is fed from spool 11 over knives 19 and 21 (see FIG. 4) and into a first roller assembly which comprises bottom roller 28 and top roller 26. Preferably, knives 19 and 21 are positioned substantially parallel to each other proximate bottom roller 28 and slice film 12 in a longitudinal direction thereby cutting film 12 into three individual webs 12*a*, 12*b* and 12*c*. As shown in FIGS. 2 and 3, web 12*b* is guided over bottom roller 28 and roller 32 while webs 12*a* and 12*c* are guided over top roller 26. Webs 12*a* and 12*c* are then each fed into separation assemblies 30 and 31.

As can be appreciated from the present disclosure, assembly 30 comprises a pair of rollers 30*a* and 30*b* which mutually operate to laterally displace (offset in a lateral direction) web 12*a* from the other webs 12*b* and 12*c*. Roller assembly 31 comprises a pair of rollers 31*a* and 31*b* which also mutually operate to laterally displace web 12*c* from the other webs 12*a* and 12*b*. As can be appreciated from the present disclosure, webs 12*a* and 12*c* are laterally separated at this point from middle web 12*b* to facilitate the packaging of individual film dosages down the line.

After webs 12*a* and 12*c* are separated a predetermined distance from web 12*b*, webs 12*a* and 12*c* are subsequently fed through rollers 34 and 36 which mutually cooperate to vertically re-align webs 12*a* and 12*c* with web 12*b* so that all of the webs 12*a*, 12*b* and 12*c* reside in spaced lateral relation on a single plane, e.g., shelf 60 shown in FIG. 3. All three webs 12*a*, 12*b* and 12*c* are then fed through a drawing mechanism which comprises a turn bar 38 having a plurality of rollers 40*a*, 40*b* and 40*c* disposed thereon. The drawing mechanism draws each corresponding web 12*a*, 12*b* and 12*c* through the previous roller assemblies and, in a preferred embodiment, aligns each web for cutting purposes. For example, roller 40*a* draws and aligns web 12*a* for cutting, roller 40*b* draws and aligns web 12*b* for cutting, etc. Preferably, TEFLON® or silicon-coated rollers are utilized to insure continuous motion of the film without adhesion to system parts, e.g., drawing rollers 40*a*, 40*b*, and 40*c*, as the film 12 moves through the system 10. In some cases, it has been found that TEFLON®-like rollers are essential to maintaining high packaging yields since some products such as the dissolvable contraceptive film have a high tendency to adhere to some metallic rollers.

Advantageously, the outer periphery of the rollers 40*a*, 40*b* and 40*c* are centered on each corresponding web 12*a*, 12*b* and 12*c*, respectively, to facilitate alignment and drawing of the webs through the system. In one particular preferred embodiment, the number of rollers is equivalent to the number of webs. As can be appreciated from the present disclosure, by reducing the number of rollers which draw the webs through the packaging system to one roller per web, the overall surface area contact between the rollers and the webs is minimized thus reducing the chances of adhesion of the film webs to the rollers.

In one embodiment, a guide plate 42 is positioned subsequent and proximate rollers 40*a*, 40*b* and 40*c* to help reduce adherence of the webs 12*a*, 12*b* and 12*c* to the rollers 40*a*, 40*b* and 40*c*, respectively. Advantageously, the guide plate comprises at least one notch located therein for receiving at least a portion of one of the rollers. Preferably, the number of notches is equivalent to the number of rollers and at least a portion of each of the rollers is inset within each of the notches. Desirably, the width of each of the notches is dimensioned to receive at least a portion of the rollers but is smaller than the width of the corresponding webs. Thus, during operation, if a portion of one of the webs adheres to the outer surface of one of the webs, the smaller width of the corresponding notch in the guide plate will prevent the web from going through the notch and continuing to adhere to the drawing roller.

After alignment, webs 12*a*, 12*b* and 12*c* continue on-line along shelf 60 and across a cutting area 61 which is located between shelves 60 and 62. Bottom packaging ply 24 is then introduced into the line at this point so that after webs 12*a*, 12*b* and 12*c* cross cutting area 61 they are positioned atop ply 24. Webs 12*a*, 12*b* and 12*c* and ply 24 are then fed into roller 48 which is located atop shelf 62. Roller 48 comprises a plurality of o-rings 50*a*, 50*b* and 50*c* which cooperate in pairs to hold down webs 12*a*, 12*b* and 12*c* for cutting purposes. As shown in FIG. 2, roller 48 comprises a pair of o-rings, e.g., 50*a* for each web, e.g., 12*a*, but in some cases it may be desirable to use a single o-ring.

In operation, webs 12*a*, 12*b* and 12*c* continue along shelf 60 and are held taught by rollers 40*a*, 40*b* and 40*c* at the one end and o-rings pairs 50*a*, 50*b* and 50*c* at the other end. As a result, webs 12*a*, 12*b* and 12*c* are held taught over the cutting area 61 where a knife 46 cuts laterally across webs 12*a*, 12*b*, 12*c* between shelves 60 and 62, thus forming individual dosages 13*a*, 13*b*, 13*c* of film 12. As can be appreciated from the present disclosure, before each dose 13*a*, 13*b*, 13*c* is cut, ply 24 is introduced under webs 12*a*, 12*b* and 12*c* so that once cut, each dose 13*a*, 13*b* and 13*c* is positioned atop ply 24. o-rings pairs 50*a*, 50*b* and 50*c* then operate to align each individual dose 13*a*, 13*b* and 13*c* on ply 24. Preferably, roller 48 rotates slightly faster than drawing mechanism 38 so that after blade 46 cuts webs 12*a*, 12*b* and 12*c*, doses 13*a*, 13*b* and 13*c* are positioned on ply 24 in a laterally spaced apart manner since ply 24 is moving slightly faster than each web 12*a*, 12*b* and 12*c* as it is drawn through the system.

Once the dosages 13*a*, 13*b* and 13*c* are aligned on ply 24, top ply 22 is aligned and introduced via rollers 64 and 66 atop dosages 13*a*, 13*b* and 13*c* so that they are positioned between plies for sealing purposes. As best shown in FIG. 3, top ply 22, bottom ply 24 and dosages 13*a*, 13*b* and 13*c* are then introduced into a mechanism 70 which seals each individual dose 13*a*, 13*b* and 13*c* between packaging plies 22 and 24 to yield the final packaged product 80.

Preferably, once the dosages 13*a*, 13*b* and 13*c* are individually sealed within plies 22 and 24, the plies 22 and 24 are then perforated between each individual dose for further packaging. Preferably, the sealing mechanism 70 produces a hermetic, pressure or vacuum-like seal around each dose to preserve the same while packaged.

From the present description, those skilled in the art will appreciate that various other modifications may be made without departing from the scope of the present invention. For example, while the system shown in the figure drawings show spool 11 being cut into three webs by a pair of knives 19 and 21 (not shown), in some cases it may be desirable to use more or less knives to produce a different number of webs. Moreover, even though knives are utilized to cut the product during the packaging process, in some case it may be desirable to utilize another method of cutting the product, e.g., a laser, a rotary or directional blade, or a scissor-like device.

Most desirably, roller assemblies are employed to manipulate and/or direct the webs at various stages throughout the system, however, in some cases it may be desirable to use other methods for manipulating the webs, e.g., stationary bars coated with low friction materials to reduce adhesion.

In some cases it may be desirable to use a mechanism which can perform more than one task simultaneously, e.g. a mechanism which both draws and aligns the webs as they are drawn through the system and/or a mechanism which both seals the individual doses between plies and perforates the packaging between dosages.

I claim:

1. A system for packaging a water soluble film within a multi-ply package, comprising:

a spool of said film comprising a medicant;

a packaging material comprising a first ply and a second ply;

means for longitudinally cutting said film into at least two webs;

means for drawing each of said webs through at least one roller assembly;

means for laterally separating said webs;

means for preventing said webs from adhering to said drawing means, said preventing means comprising a guide plate comprising at least one notch located therein;

means for transversely cutting said webs into individual dosages of said film; and means for sealing said dosages between said plies.

2. A system according to claim 1 wherein the width of said at least one notch is less than the width of said webs.

3. A system according to claim 1 wherein said drawing means comprises at least two rollers and said guide plate comprises at least two notches and wherein each of said at least two rollers are centrally aligned over each of at least two webs, and wherein at least a portion of each of said at least two rollers is inset within each of said at least two notches.

4. A system according to claim 3 wherein each of said at least two notches are centrally aligned over each of said at least two webs.

5. A system according to claim 1 wherein said drawing means comprises a turn bar comprising at least one roller attached thereto wherein at least a portion of said at least one roller is at least partially inset within said at least one notch.

6. A system according to claim 5 wherein said guide plate is located after said rollers.

7. A system according to claim 5 wherein said guide plate is selectively adjustable from a first position proximate said turn bar to at least one second position farther from said turn bar.

8. A system according to claim 5 wherein said at least one roller comprise a synthetic resin polymer product.

9. A system according to claim 5 wherein the number of said at least one roller is equivalent to the number of said webs.

10. A system according to claim 9 wherein and the number of said at least one notch is equivalent to the number of said at least one roller.

11. A method of providing a water soluble film within a multi-ply package comprising the steps of:

feeding a spool of said film into a roller assembly;

longitudinally cutting said film into at least two webs;

drawing each of said webs through at least one roller assembly;

laterally separating said webs;

preventing said webs from adhering to said at least one roller assembly by utilizing a guide plate comprising at least one notch located therein;

transversely cutting said webs into individual dosages of said film; and sealing said dosages between said plies.

12. A method according to claim 11 further comprising the step of aligning said dosages onto one of said plies.

13. A method according to claim 11 wherein the step of drawing each of said at least one web through a roller assembly comprises at least one drawing roller.

14. A method according to claim 11 wherein the step of drawing each of said at least one web through said at least one roller assembly comprises one drawing roller for each web of said film.

15. A method according to claim 11 wherein said guide plate comprises one notch for each web of said film.

16. A method according to claim 15 wherein the width of each of said notches is smaller than the width of each corresponding web.

* * * * *